US008446230B2

(12) United States Patent
Cisco et al.

(10) Patent No.: US 8,446,230 B2
(45) Date of Patent: May 21, 2013

(54) MICROWAVE DIRECTIONAL COUPLER

(75) Inventors: Terry Cisco, Glendale, CA (US); Mary A. Teshiba, Torrance, CA (US)

(73) Assignee: Raytheon Company, Waltham, MA (US)

( * ) Notice: Subject to any disclaimer, the term of this patent is extended or adjusted under 35 U.S.C. 154(b) by 335 days.

(21) Appl. No.: 12/790,507

(22) Filed: May 28, 2010

(65) Prior Publication Data

US 2011/0291770 A1 Dec. 1, 2011

(51) Int. Cl.
*H01P 5/18* (2006.01)
*H01P 3/08* (2006.01)

(52) U.S. Cl.
USPC ..... 333/116; 333/109

(58) Field of Classification Search
USPC ..... 333/109, 110, 112, 115, 116, 238
See application file for complete search history.

(56) References Cited

U.S. PATENT DOCUMENTS

| | | | | |
|---|---|---|---|---|
| 3,516,024 | A | 6/1970 | Lange | |
| 4,459,568 | A * | 7/1984 | Landt | 333/116 |
| 5,012,209 | A * | 4/1991 | Lantagne et al. | 333/116 |
| 5,111,165 | A * | 5/1992 | Oldfield | 333/116 |
| 6,166,441 | A * | 12/2000 | Geryk | 257/773 |
| 7,075,387 | B2 * | 7/2006 | Paakkonen et al. | 333/116 |
| 7,151,421 | B2 * | 12/2006 | Shinabe et al. | 333/116 |

FOREIGN PATENT DOCUMENTS

| | | |
|---|---|---|
| EP | 1 753 072 A1 | 2/2007 |
| JP | 54 132154 | 10/1979 |
| JP | 2006 074830 | 3/2006 |

OTHER PUBLICATIONS

Extended European Search Report for European Application No. 11154825.1, Applicant Raytheon Company, European Search Report dated Jun. 7, 2011 and mailed Jun. 14, 2011 (6 pgs.).

Waugh, et al. "Unfolding the Lange Coupler", Short Papers, IEEE Transactions on Microwave Theory and Techniques, Nov. 1972 (pp. 777-779).

* cited by examiner

*Primary Examiner* — Dean O Takaoka
(74) *Attorney, Agent, or Firm* — Christie, Parker & Hale, LLP

(57) ABSTRACT

Directional couplers are provided. In one embodiment, the directional coupler includes first and second transmission line segments positioned on a first plane and spaced apart by a first distance, third and fourth transmission line segments positioned on a second plane and spaced apart by a second distance, the second plane spaced apart from the first plane, a first conductive segment connecting the first and third transmission line segments, and a second conductive segment connecting the second and fourth transmission line segments, where the first and second transmission line segments are configured to couple energy therebetween, and where the third and fourth transmission line segments are configured to couple energy therebetween.

14 Claims, 6 Drawing Sheets

MICROWAVE DIRECTIONAL COUPLER

FIELD OF THE INVENTION

The present invention relates generally to directional couplers. More specifically, the invention relates to a microwave directional coupler having a structure that allows for coupling along more than one plane.

BACKGROUND

Directional couplers are passive devices typically used in radio frequency applications to couple part of the transmission power or energy in a transmission line by a known amount out through another port. Often the coupling is achieved by using two transmission lines set close enough together such that energy passing through one line is coupled to the other line. Designers of directional couplers often need to determine a mechanical layout of these transmission lines to accomplish a preselected degree of coupling. Often this preselected degree of coupling is 3 dB or less and constrains the designer to position the lines very close together, which can create manufacturing and/or fabrication yield problems. More specifically, in some cases, the designer can be constrained by the rules associated with a design tool for laying out the transmission lines.

Conventional directional couplers can include interdigitated coupling segments positioned on a flat surface. U.S. Pat. No. 3,516,024 to Lange describes such an interdigitated strip line coupler. A variation of the Lange coupler is described by Waugh and LaCombe in an IEEE article. (Waugh, R., LaCombe, D.: "'Unfolding' the Lange Coupler", IEEE Trans., 1972, MTT-20, pp. 777-779). These conventional couplers can however be difficult and expensive to manufacture in some circumstances. In addition, the performance of these conventional couplers can be limited.

SUMMARY

Aspects of the invention relate to directional couplers that allow for coupling on more than one plane. In one embodiment, the directional coupler includes first and second transmission line segments positioned on a first plane and spaced apart by a first distance, third and fourth transmission line segments positioned on a second plane and spaced apart by a second distance, the second plane spaced apart from the first plane, a first conductive segment connecting the first and third transmission line segments, and a second conductive segment connecting the second and fourth transmission line segments, where the first and second transmission line segments are configured to couple energy therebetween, and where the third and fourth transmission line segments are configured to couple energy therebetween.

DETAILED DESCRIPTION

Figure 1:
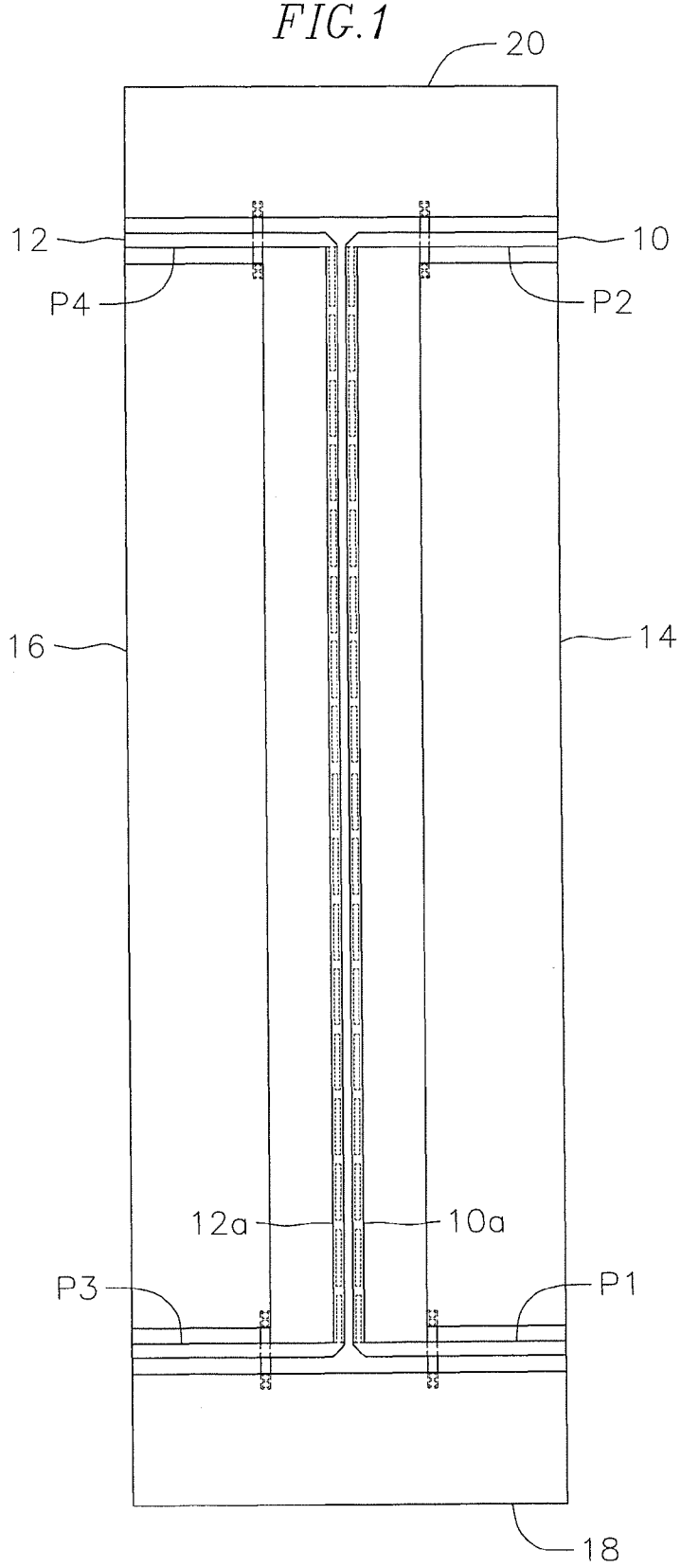
FIG. 1 is a top view of a directional coupler in accordance with one embodiment of the invention.

Referring now to the drawings, embodiments of directional couplers have a three dimensional structure that provides coupling on more than one plane. Embodiments of the coupler structures include first and second transmission line coupling segments positioned on a first plane, spaced apart by a first distance, and third and fourth transmission line coupling segments positioned on a second plane, spaced apart by a second distance, where the second plane is spaced apart from the first plane. Embodiments of the coupler structures further include conductive segments that connect the first and third transmission line segments, and the second and fourth transmission line segments, respectively. The first and second transmission line segments are configured to couple energy between the transmission line segments. Similarly, the third and fourth transmission line segments are configured to couple energy between the transmission line segments. In contrast to conventional directional couplers, embodiments of coupler structures described herein provide coupling on more than one plane using at least two transmission line coupling segments.

In some embodiments, a cross section of the coupler structures can have a I-beam shape. In other embodiments, the coupler structures can have other suitable shapes.

FIG. 1 is a top view of a directional coupler in accordance with one embodiment of the invention. The directional coupler includes a first transmission line 10 and a second transmission line 12 interleaved among a number of interconnected ground planes (14, 16, 18, 20). The first and second transmission lines (10, 12) include closely positioned coupling segments (10*a*, 12*a*) disposed along a first plane that extends in the same plane as the ground planes (14, 16, 18, 20). The first and second transmission lines (10, 12) also include closely positioned coupling segments (see FIG. 2) along a second plane positioned below, or spaced apart from, the first plane.

Figure 2:
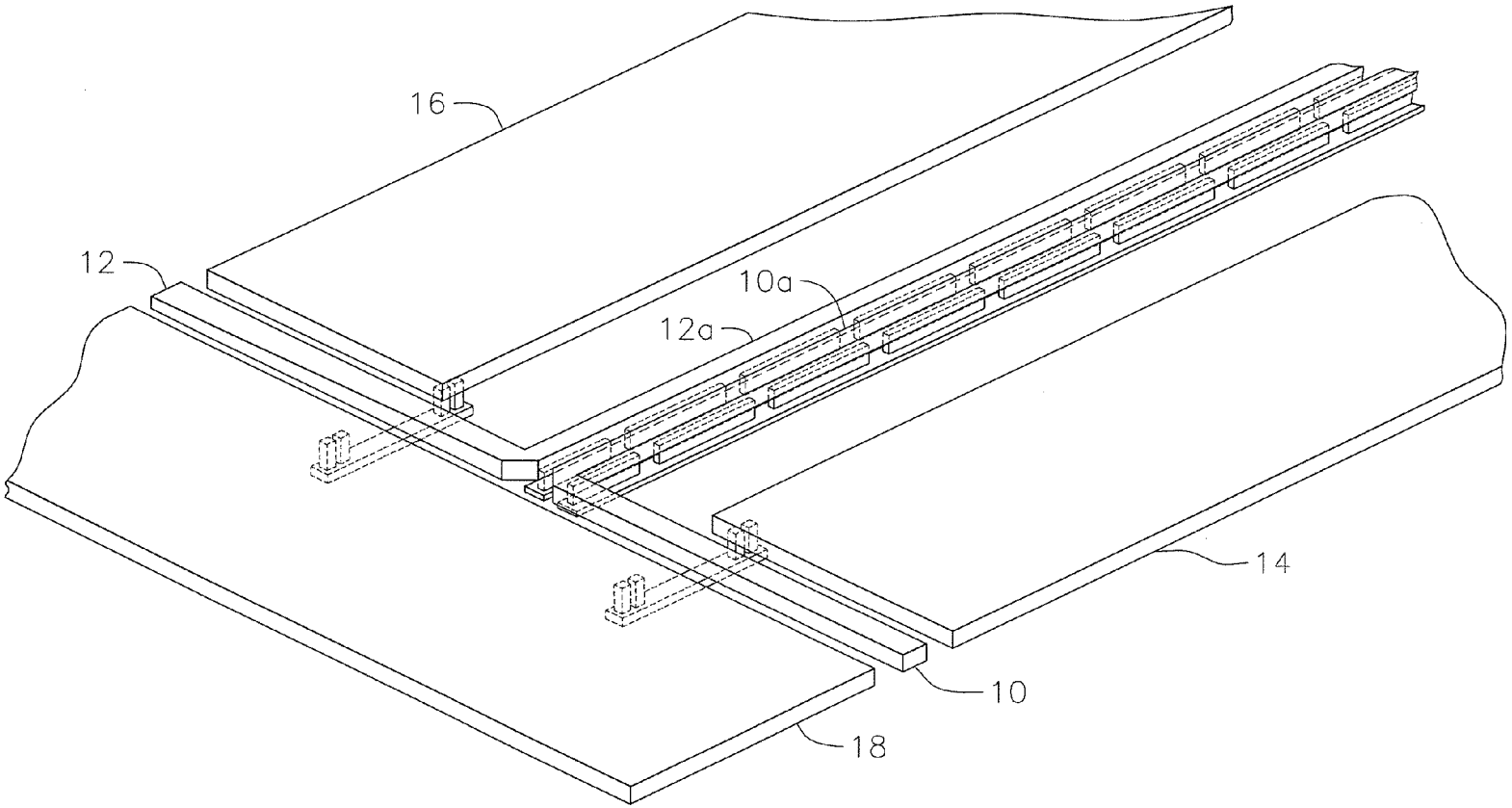
FIG. 2 is a perspective view of a portion of the directional coupler of FIG. 1 in accordance with one embodiment of the invention.

FIG. 2 is a perspective view of a portion of the directional coupler of FIG. 1 in accordance with one embodiment of the invention.

Figures 3, 4:
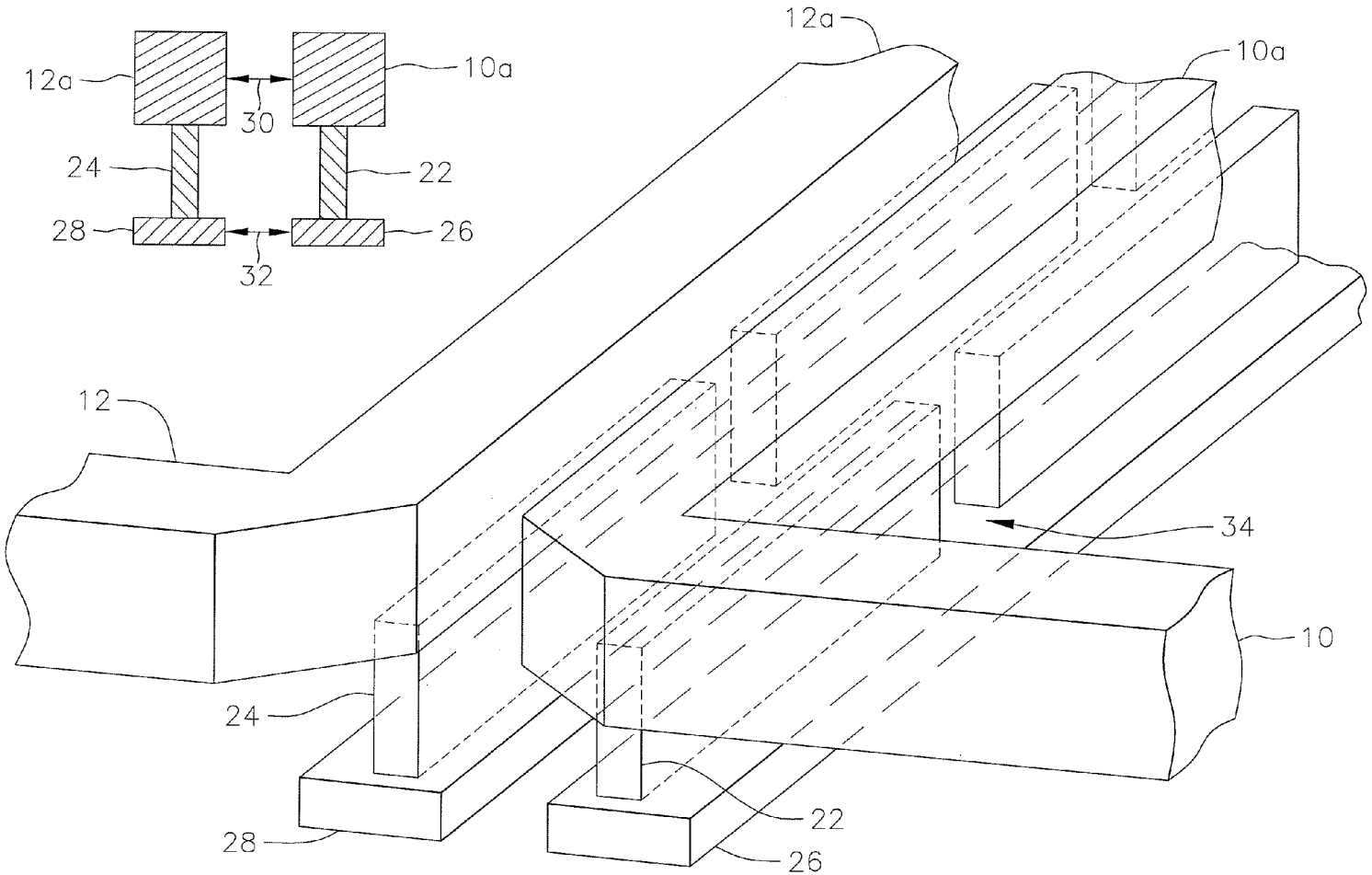
FIG. 3 is a expanded view of an end portion of the directional coupler of FIG. 2 in accordance with one embodiment of the invention.
FIG. 4 is a cross sectional view of a cross section taken along the transmission line coupling segments of the directional coupler of FIG. 3 in accordance with one embodiment of the invention.

FIG. 3 is a expanded view of an end portion of the directional coupler of FIG. 2 in accordance with one embodiment of the invention.

FIG. 4 is a cross sectional view of a cross section taken along the transmission line coupling segments of the directional coupler of FIG. 3 in accordance with one embodiment of the invention.

Referring now to FIGS. 2-4, the first and second transmission line coupling segments (10*a*, 12*a*) each have an elongated body with a square or rectangular cross section and are positioned in a top plane. First and second transverse conductive segments (22, 24) each are attached to a bottom surface of one of the first and second transmission line segments (10*a*, 12*a*). The transverse conductive segments (22, 24) each have an elongated body and a rectangular cross section with a length of the cross section extending perpendicular to the bottom surfaces of each of the first and second transmission line segments (10*a*, 12*a*). Top surfaces of each of the third and fourth coupling segments (26, 28) are attached to the transverse conductive segments (22, 24), respectively. The third and fourth coupling segments (26, 28) each have a rectangular cross section with a length of the cross section extending perpendicular to the length of the cross section of the transverse conductive segments (22, 24). The third and fourth coupling segments (26, 28) are positioned below the first and second coupling segments (10*a*, 12*a*) in a bottom plane spaced apart from the top plane by a distance about equal to the length of one of the transverse conductive segments (22, 24). The first and second coupling segments (10*a*, 12*a*) are separated by a top coupling distance or gap 30, while the third and fourth coupling segments (26, 28) are separated by a bottom coupling distance or gap 32.

In the embodiments illustrated in FIGS. 2-4, the first coupling segment 10*a*, the first transverse conductive segment 22, and third coupling segment 26 form an I-beam cross section, or considered from a different direction, an H-beam cross section. Similarly, the second coupling segment 12*a*, the second transverse conductive segment 24, and fourth coupling segment 28 form an I-beam cross section. For an I-beam cross section or other similar structure, the coupling segments (10*a*, 12*a*, 26, 28) can be referred to as flanges while the transverse conductive segments (22, 24) can be referred to as webs. The I-beam cross section with two flanges can provide for better coupling performance than conventional directional couplers. In particular, as compared to conventional couplers, the third and fourth coupling segments (26, 28) can provide coupling in a second plane in addition to the primary coupling segments (e.g., 10*a*, 12*a*).

The overall degree of coupling is a function of the distances or gaps (30, 32) between the coupling segments (10*a*, 12*a*, 26, 28) or flanges. More specifically, the smaller the gap (30, 32) between the flanges, the greater the coupling. The smaller gap can increase the capacitance between the transmission line (10*a* to 12*a*, 22 to 24, and 26 to 28) surfaces facing each other. In the embodiments illustrated in FIGS. 2-4, the top gap 30 is about equal to the bottom gap 32. In other embodiments, the gaps can be unequal. In several embodiments, the distances or gap spacing are determined to achieve a degree of coupling that is about 3 dB, representing an equal split of the input power level. In other embodiments, other degrees of coupling can be achieved. In one embodiment, the top gap is 2.9 microns, and the bottom gap is 2.9 microns. In such case, the first and second conductor widths (10*a* and 12*a*) can both be 3.7 microns, while the widths of the third and fourth transmission line conductors (26 and 28) can also be 3.7 microns. The widths of the transverse conductive segments (22 and 24) can both be 1.3 microns, the gap between them can be 5.3 microns.

In several embodiments, the gaps (30, 32) between the flanges are filled with air. In other embodiments, other dielectric materials can fill the gaps. In such embodiment, the gaps include various coatings including 1 um of oxygen, 1.35 um of silicon nitride, 0.45 um of nitride and an average of 2.5 um of polyimide. In several embodiments, the higher the dielectric constant of the dielectric material used to fill the gaps, the greater the gap spacing can be to achieve a preselected degree of coupling.

Figure 4A:
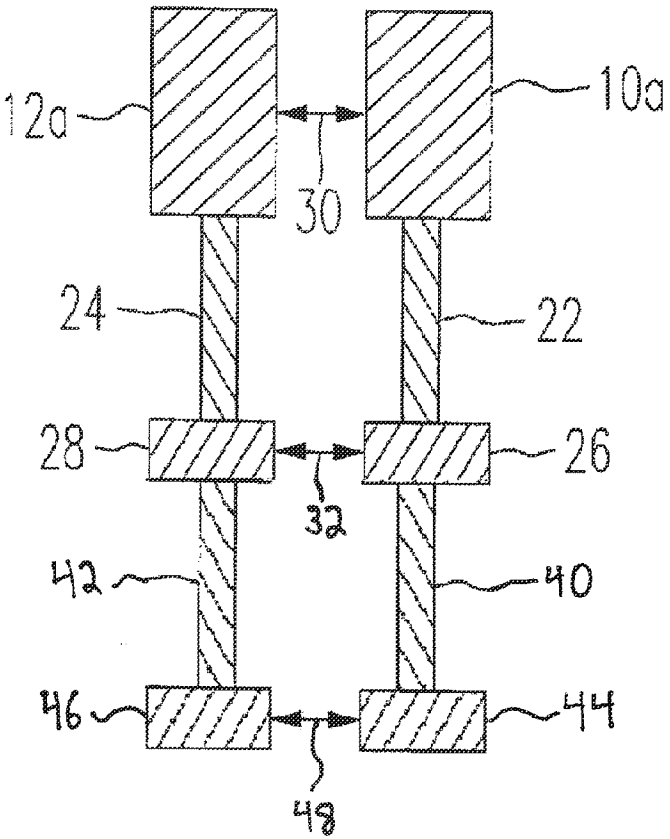
FIG. 4A is a cross sectional view of a cross section taken along transmission line coupling segments of a directional coupler in accordance with one embodiment of the invention.

In the embodiments illustrated in FIGS. 2-4, there are two flanges (10*a*, 26 and 12*a*, 28) coupled by a single web (22 and 24) for each transmission line (10 and 12). In other embodiments, the transmission line coupling structures may include more than two flanges and additional webs for additional coupling. In one such case, an additional flange is positioned on a third plane spaced apart from the top and bottom planes and coupled to either flange 10*a* or 26 using an additional web. FIG. 4*a* illustrates an embodiment of this configuration with an additional flange (44 and 46) positioned on a third plane and coupled to a flange (26 and 28) via an additional web (40 and 42). The additional flange and web form a gap 48 between the additional coupling segments 44 and 46. In FIG. 4, each web is slightly offset from a center of the flanges it is attached to. More specifically, each web is slightly offset towards the opposing web. In some embodiments, each web can be positioned even closer to the opposing web than depicted in FIG. 4. In other embodiments, each web can be centered with respect to the flanges attached thereto.

In the embodiment illustrated in FIGS. 2-3, the webs (22, 24) include periodic gaps 34 along the lengths of the webs. In other embodiments, these gaps can be wider than illustrated in FIGS. 2-3. In some embodiments, no gap is present in the webs. In one embodiment, the gap is due to a design rule associated with a particular software layout tool. In some embodiments, the gaps has little or no effect on the coupling performance of the directional coupler. In such case, use of the gaps serve to minimize cost associated with unnecessary material.

In the embodiments illustrated in FIGS. 2-4, the directional coupler includes two coupling structures having an I-beam shaped cross section. In other embodiments, the coupling structures can have other suitable cross sectional shapes. In one such embodiment, for example, the coupling structures can have a J-shaped, T-shaped and/or L-shaped cross section. In some embodiments, the shape of the coupling structure is determined, at least in part, based on design rules associated with a particular software layout tool for transmission lines. In one such embodiment, those design rules may be provided by a particular foundry supplying the layout tool. In the embodiments illustrated in FIGS. 2-4, the directional coupler includes two symmetrical coupling structures. In other embodiments, the coupling structures are not symmetrical.

In several embodiments, the coupling structures are made of conductive materials. In one embodiment, for example, the flanges are made of copper and the webs are made of tungsten. In other embodiments, other suitable conductive materials can be used. In some embodiments, the coupling structures are made of aluminum.

Returning briefly to FIG. 1, for an electrical performance analysis, the directional coupler can be considered a four port device having an input port P1, a transmitted port P2, a coupled port P3, and an isolated port P4.

Figure 5:
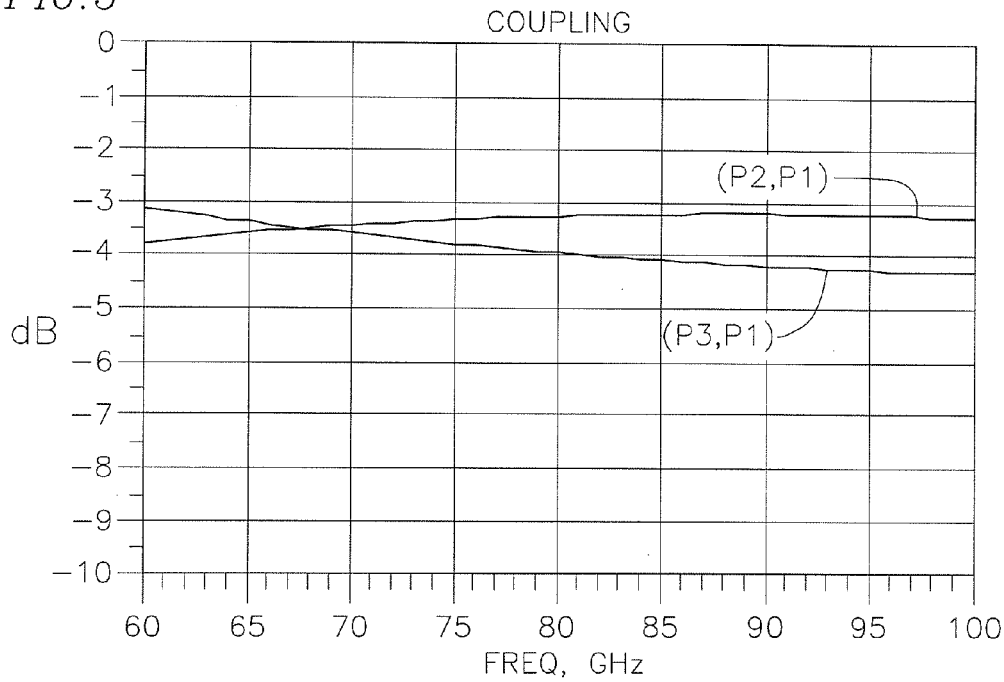
FIG. 5 is a graph of coupling verses the frequency for a directional coupler in accordance with one embodiment of the invention.

FIG. 5 is a graph of coupling verses the frequency for a directional coupler in accordance with one embodiment of the invention. The trace (P3, P1) represents the logarithm of the ratio of the power into port P3 divided by the power out of the port P1 expressed in decibels. The trace (P2, P1) represents the degree of coupling appearing at the transmitted or direct port P2. As illustrated in FIG. 5, the degree of coupling for the coupled port P3 is at least 3 dB and increases beyond 4 dB as the frequency increases for the given frequency range.

Figure 6:
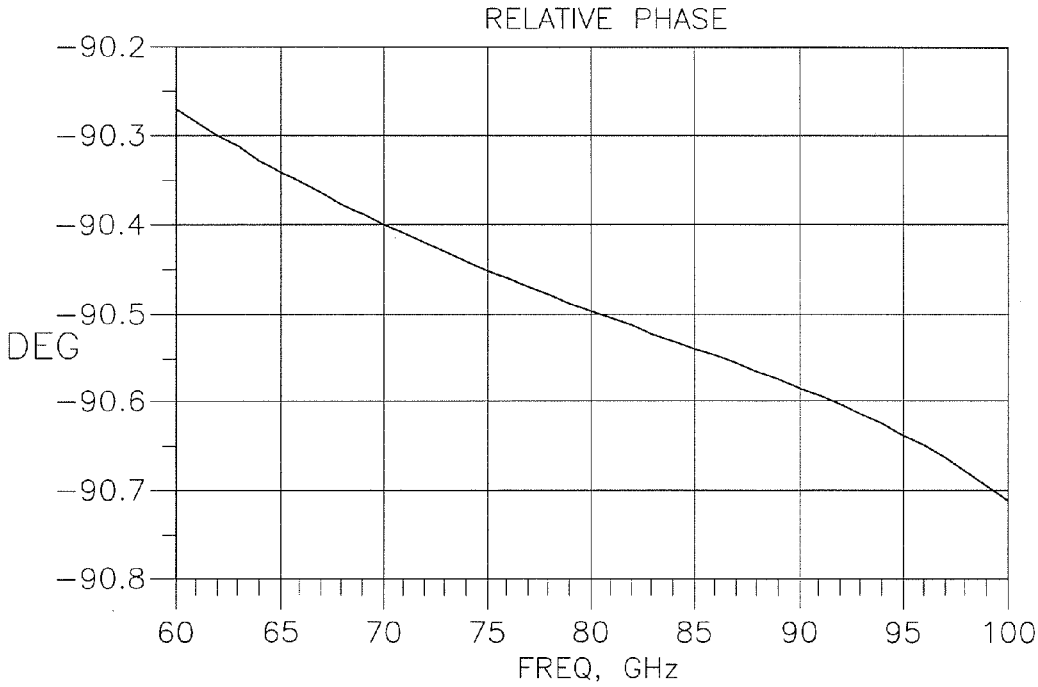
FIG. 6 is a graph of relative phase verses the frequency for a directional coupler in accordance with one embodiment of the invention.

FIG. 6 is a graph of relative phase verses the frequency for a directional coupler in accordance with one embodiment of the invention. The relative phase can be thought of as the difference in phase between an input wave to the directional coupler and an output wave of the directional coupler.

Figure 7:
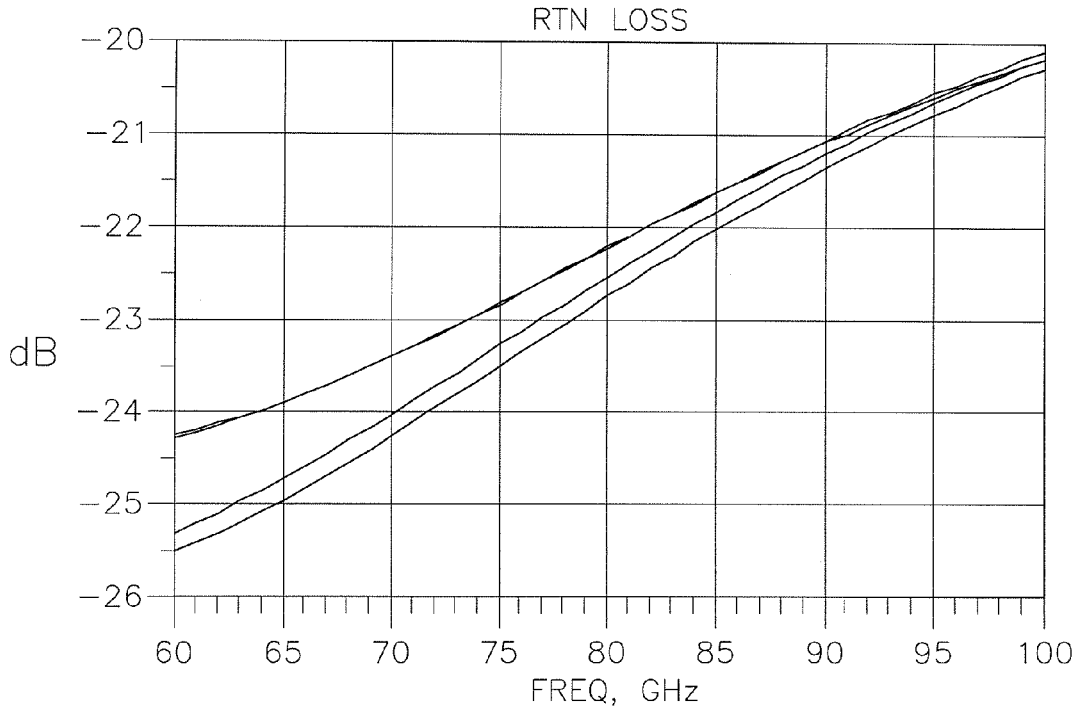
FIG. 7 is a graph of return loss verses the frequency for a directional coupler in accordance with one embodiment of the invention.

FIG. 7 is a graph of return loss verses the frequency for each port of a directional coupler in accordance with one embodiment of the invention.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A directional coupler comprising:

first and second transmission line segments positioned on a first plane and spaced apart by a first distance;

a first ground plane positioned adjacent to the first transmission line segment and on the first plane;

a second ground plane disposed adjacent to the second transmission line segment and on the first plane, wherein the first and second transmission line segments are positioned between the first round plane and the second ground plane;

third and fourth transmission line segments positioned on a second plane and spaced apart by a second distance, the second plane spaced apart from the first plane;

a first conductive segment connecting the first and third transmission line segments; and a second conductive segment connecting the second and fourth transmission line segments, wherein the first and second transmission line segments are configured to couple energy therebetween, and wherein the third and fourth transmission line segments are configured to couple energy therebetween.

2. The coupler of claim 1:

wherein an amount of energy coupled between the first and second transmission line segments is determined, at least in part, by the first distance; and wherein an amount of energy coupled between the third and fourth transmission line segments is determined, at least in part, by the second distance.

3. The coupler of claim 1:

wherein the first transmission line segment, the third transmission line segment, and the first conductive segment comprise an I-beam shaped cross section; and wherein the second transmission line segment, the fourth transmission line segment, and the second conductive segment comprise an I-beam shaped cross section.

4. The coupler of claim 1:

wherein the first transmission line segment, the third transmission line segment, and the first conductive segment comprise a J-shaped cross section; and wherein the second transmission line segment, the fourth transmission line segment, and the second conductive segment comprise a J-shaped cross section.

5. The coupler of claim 1:

wherein the first and second transmission line segments comprise a conductor having a rectangular cross section and an elongated length;

wherein the third and fourth transmission line segments comprise a conductor having a rectangular cross section and an elongated length; and wherein the first and second conductive segments comprise a conductor having a rectangular cross section and an elongated length.

6. The coupler of claim 5:

wherein a length of each of the rectangular cross sections of the first, second, third, and fourth transmission line segments extends in a first direction; and wherein a length of each of the rectangular cross sections of the first and second conductive segments extends in a second direction transverse to the first direction.

7. The coupler of claim 5:

wherein the elongated lengths of the first and second conductive segments comprise periodic gaps.

8. The coupler of claim 1, further comprising:

fifth and sixth transmission line segments positioned on a third plane and spaced apart by a third distance, the third plane spaced apart from the first and second planes;

a third conductive segment connecting the third and fifth transmission line segments; and a fourth conductive segment connecting the fourth and sixth transmission line segments, wherein the fifth and sixth transmission line segments are configured to couple energy therebetween.

9. The coupler of claim 1, wherein the first and second transmission line segments each comprises a substantially square cross section.

10. The coupler of claim 1:

wherein the first transmission line segment is a component of a first transmission line comprising a first U-shaped section with two end legs and a middle segment joining the two end legs of the first U-shaped section;

wherein the first U-shaped section is disposed on the first plane;

wherein the second transmission line segment is a component of a second transmission line comprising a second U-shaped section with two end legs and a middle segment joining the two end legs of the second U-shaped section;

wherein the second U-shaped section is disposed on the first plane; and wherein the middle segment of the first U-shaped section is adjacent, and substantially parallel, to the middle section of the second U-shaped section.

11. The coupler of claim 1, wherein the first transmission line segment is substantially parallel to the second transmission line segment.

12. The coupler of claim 1, wherein the first and second transmission line segments are electrically isolated from any ground plane.

13. The coupler of claim 1, wherein the first conductive segment and the second conductive segment each comprises a rectangular block shape.

14. A directional coupler comprising:

first and second transmission line segments positioned on a first plane and spaced apart by a first distance;

third and fourth transmission line segments positioned on a second plane and spaced apart by a second distance, the second plane spaced apart from the first plane;

a first conductive segment connecting the first and third transmission line segments; and a second conductive segment connecting the second and fourth transmission line segments, wherein the first and second transmission line segments are configured to couple energy therebetween, wherein the third and fourth transmission line segments are configured to couple energy therebetween, wherein the first, second, third, and fourth transmission line segments comprise at least one conductive material, wherein the at least one conductive material comprises copper, and wherein the first and second conductive segments comprise tungsten.

* * * * *